United States Patent [19]

Hashimoto

[11] Patent Number: 4,631,927

[45] Date of Patent: Dec. 30, 1986

[54] AIR CONDITIONER

[75] Inventor: Yasuhiko Hashimoto, Fujieda, Japan

[73] Assignee: Mitsubishi Denki Kabushiki Kaisha, Tokyo, Japan

[21] Appl. No.: 731,398

[22] Filed: May 7, 1985

[30] Foreign Application Priority Data

May 25, 1984 [JP] Japan ..... 59-106248

[51] Int. Cl.[4] ..... F25B 47/00

[52] U.S. Cl. ..... 62/280; 62/305

[58] Field of Search ..... 62/279, 280, 304, 305

[56] References Cited

U.S. PATENT DOCUMENTS 2,793,510 5/1957 Komroff et al. ..... 62/280
2,912,171 11/1959 Merrick ..... 62/280
4,424,686 1/1984 Lapeyre et al. ..... 62/279

FOREIGN PATENT DOCUMENTS 2129532 10/1983 United Kingdom .

*Primary Examiner*—Henry Bennett
*Attorney, Agent, or Firm*—Oblon, Fisher, Spivak, McClelland, & Maier

[57] ABSTRACT

An air conditioner having an air-blowing and water-spattering fan, a condenser disposed on both sides of the fan in mutual confrontation, and one or more guide members to lead drain water to each condenser, wherein each guide member is disposed on the ceiling surface of the air conditioning apparatus contiguous with the top part of each condenser to enable the drain water flowing on and along the ceiling surface to be uniformly distributed over substantially the entire width of the condensers on the top part thereof.

4 Claims, 13 Drawing Figures

AIR CONDITIONER

BACKGROUND OF THE INVENTION

1. Field of the Invention

This invention relates to an air conditioner having a function of utilizing drain water for heat dissipation of a condenser.

2. Discussion of the Background

FIGS. 1 through 3 of the accompanying drawing are respectively a plan view, a side elevational view and a front elevational view, partly in cross-section, showing a conventional air conditioning apparatus. In the drawing, a reference numeral 1 designates a base; a numeral 2 refers to a cooling means; a numeral 3 designates a receiving tray disposed beneath this cooling device 2; a reference numeral 5 indicates a partitioning plate provided at the back side of the air conditioning apparatus to hold thereon a casing 4. A numeral 6 refers to an electric motor with a motor shaft 7 situated in the abovementioned base 1. At both ends of the motor shaft 7, there are mounted an indoor fan 8 and an air-blowing and water-spattering fan 9. At both sides of the air-blowing and water-spattering fan 9, there are disposed condensers 10, 10. A numeral 11 refers to a bellmouth. By rotation of the abovementioned air-blowing and water-spattering fan 9, air is introduced into the base 1, which is cooled and condensed, while it is passing through the cooling device. Drain water resulting from the condensation is collected into the receiving tray 3, and is spattered onto the condenser 10 by the centrifugal force produced form rotation of the air-blowing and water-spattering fan 9 which is used for the heat-dissipation of the condenser 10.

In the conventional air conditioner of the above-described construction, water which has been scooped up by the air-blowing and water-spattering fan 9 hits the edge portion 12 of a water spattering member 13 to be splashed within the limited width of the edge portion 12 of the water spattering member 13, and is spattered onto the condenser without further expansion. Also the drain water which has reached the ceiling surface 14 moves in the rotational direction of the air-blowing and water-spattering fan 9 to be scattered on the condenser 10 at the opposite side. In such manner of water spattering, however, since the drain water is spattered onto the condenser 10 with the limited width of the edge portion 12 of the water spattering member 13 which is disposed in contiguity to the air-blowing and water-spattering fan 9, the efficiency in the heat dissipation of the condenser is poor and the drain water overflows from the base 1 without its being perfectly evaporated by heat from the condenser 10, which is the disadvantage inherent in the conventional air conditioning apparatus.

SUMMARY OF THE INVENTION

The present invention has been made with a view to improving such disadvantage with the conventional air conditioning apparatus, and aims at providing an air conditioner having good heat dissipating efficiency and being capable of preventing the drain water from overflowing the base, which is attained by causing the drain water flowing on and along the ceiling surface of the apparatus to be uniformly spattered onto the condenser through a guide member which is disposed in contiguity to the top part of the condenser so as to scatter the drain water over the top part and the substantially entire width of the condenser.

BRIEF DESCRIPTION OF THE DRAWINGS

One way of carrying out the invention is described in detail hereinbelow with reference to the accompanying drawings which illustrate a few specific embodiments thereof, in which:

FIG. 4 is a plan view showing one embodiment of the air conditioner according to the present invention;

FIGS. 5 and 6 are respectively a side elevational view and a front elevational view, partly in cross-section, of the air conditioner shown in FIG. 4;

FIG. 7 is a plan view showing another embodiment of the air conditioner according to the present invention;

FIG. 8 is a side elevational view, partly in cross-section, of the air conditioner shown in FIG. 7;

DESCRIPTION OF THE PREFERRED EMBODIMENTS

Figure 1:
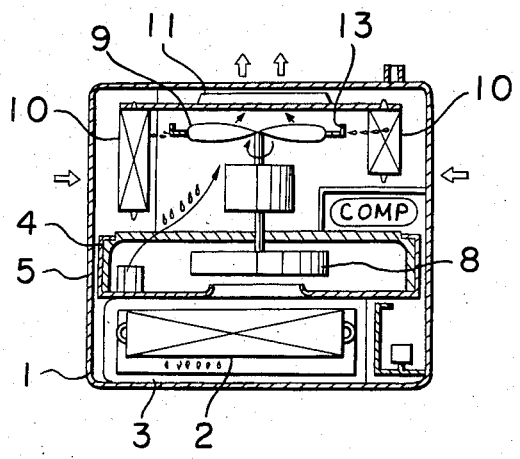
FIGS. 1 to 8 are respectively a plan view, a side elevational view and a front elevational view, partly in cross-section, of a conventional air conditioning apparatus.
Figure 2:
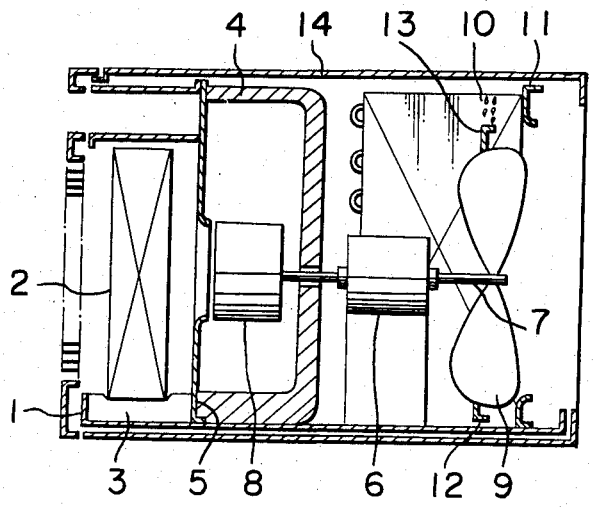
Figure 3:
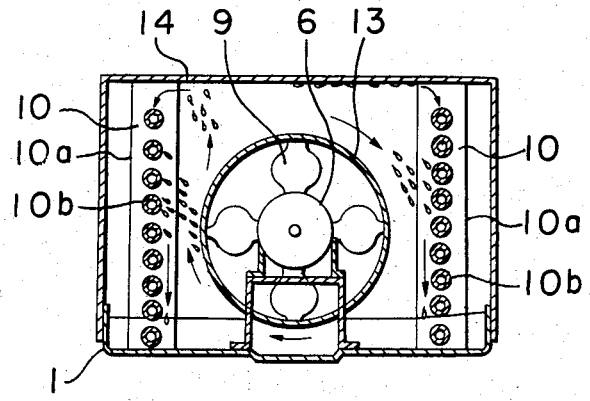

In the following discussed, the present invention will be described in detail with reference to preferred embodiments thereof shown in the drawing.

Figure 4:
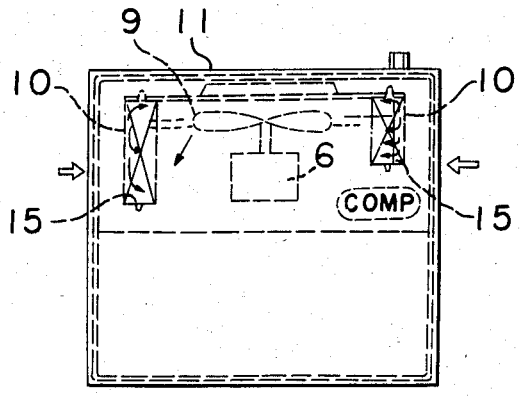
Figure 5:
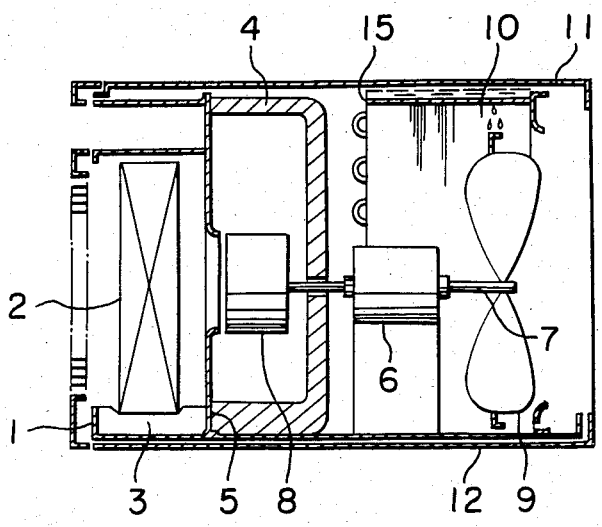
Figure 6:
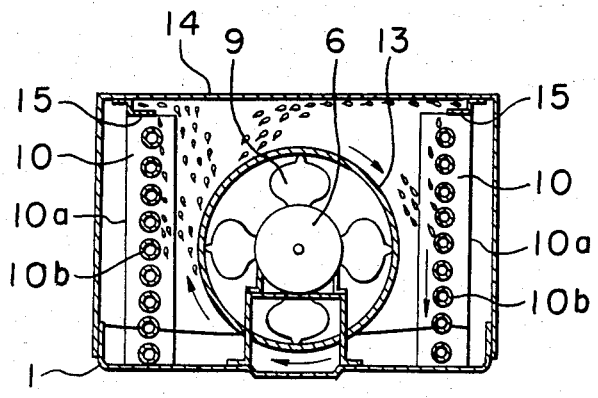

FIGS. 4 to 6 illustrate one embodiment of the air conditioning apparatus according to the present invention, in which reference numerals 1 through 14 inclusive designate identical parts with those in the above-described conventional air conditioning apparatus. A numeral 15 refers to a weir-shaped rail serving as a guide member, which is disposed on the ceiling surface of the air conditioning apparatus. One surface of this guide member in a staggered shape in its cross-section (or in a shape of the letter 'Z') is positioned close to the condenser 10. The rail 15 is disposed in parallel with the condenser 10 along a length equal to the total width of the condenser 10.

When the air conditioner of the above-described construction is brought into operation, drain water collected at the base 1 is spattered by the centrifugal force caused by rotation of the air-blowing and water-spattering fan 9. In this case, a part of the drain water is directly scattered on the condenser 10, while the remaining portion thereof is forced over the ceiling surface 14 to flow toward the condenser 10. The drain water which has reached a position above the condenser 10 hits the guide rail 15, is then separated into the right and the left, and drips onto the condenser, while it is flowing.

In the above-described embodiment, the air conditioner is of such a construction that the guide rail 15 is disposed on the ceiling surface 14 in parallel with the direction of width of the condenser 10 so that the drain water may be spattered uniformly over the condenser 10. It should however be noted that the same result can be expected by disposing the guide rail 15 with an inclination toward the direction of the width of the condenser 10.

Figure 7:
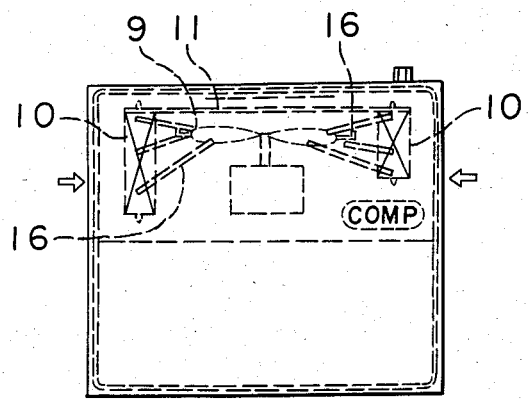
Figure 8:
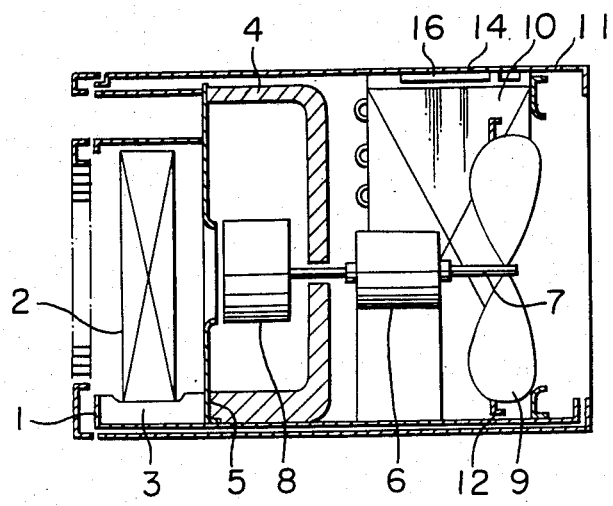
Figure 9:
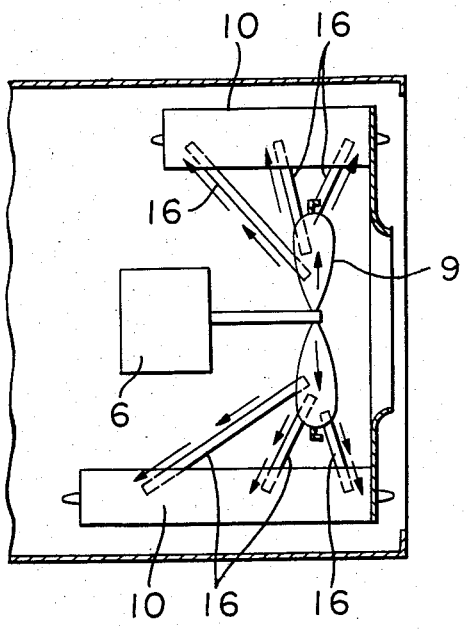
FIG. 9 is an enlarged plan view of the air conditioner shown in FIG. 7 setting forth a detailed illustration of the arrangement of the water guide rails.
Figures 10, 11, 13:
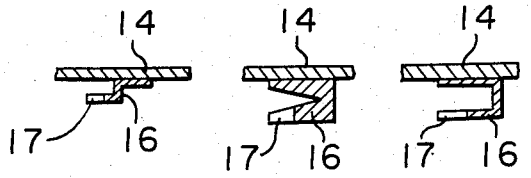
FIGS. 10 to 12 are cross-sectional views of the water guide rails, each having a groove of different configuration.
FIG. 13 is a plan view of the water guide rail shown in FIGS. 10 to 12.
Figure 12:
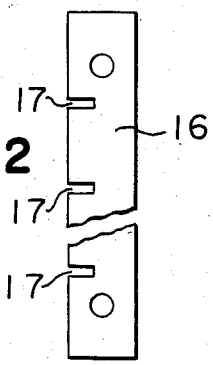

FIGS. 7 to 9 illustrate another embodiment of the air conditioner according to the present invention, in which the guide member is disposed on the ceiling surface 14 in a manner different from the above-described first embodiment in FIGS. 4 to 6. That is to say, a plurality of guide rails 16 are disposed radially at a position, where the drain water begins to flow on and along the ceiling surface 14, as the starting point. In this construction, the drain water which is scattered by rotation of the air-blowing and water-spattering fan 9 flows on and along the ceiling surface 14 with a width of the edge portion 12 of the water spattering member 13, in the course of which it is separated and distributed by the radially arranged guide rails 16 to be led to the position above the condenser 10. The drain water which has arrived at the condenser 10 drips from each of the guide rails 16 onto the condenser 10. By thus disposing a plurality of guide rails 16 on the ceiling surface 14 in the radially extending direction toward the condenser 10 at a position on the ceiling surface 14 where the drain water begins to flow, as the starting point, the heat dissipating efficiency of the condenser 10 becomes extremely improved and the drain water is perfectly evaporated without its overflowing the base 1.

In the first-mentioned embodiment shown in FIGS. 4 to 6, the guide rail 15 is disposed in parallel with the condenser 10. As is apparent from the above-described operating principle, this arrangement serves to spatter the drain water evenly onto the condenser 10 in utilization of the centrifugal force imparted to the drain water. Such intended purpose can be attained successfully with the guide rails 16 having a groove of different configuration formed, as shown in FIGS. 10 to 13, so as to enable the drain water dripping from the guide rail 16 to scatter uniformly on the top part of the condenser 10.

As has been explained in the foregoing, the present invention provides a remarkable effect such that, with its simple construction of disposing the guide member in contiguity to the top part of the condenser, the drain water is spattered uniformly onto the condenser to thereby increase its heat dissipating efficiecy and prevent the drain water from overflowing the base.

I claim:

1. An air conditioning apparatus, comprising:

an air-blowing and water-scattering fan;

at least one condenser disposed on both sides of said fan in mutual confrontation, and at least one guide member disposed contiguous with the top part of each of said condensers to enable drain water flowing on and along the ceiling surface of said apparatus to be uniformly distributed over substantially the entire width of said condensers on the top part thereof wherein said at least one guide member further comprises a plurality of guide members radially disposed on the ceiling surface toward the top part of each of said condensers along the axial length of each of said condensers at a position where the drain water begins to flow as a starting point so as to evenly distribute water onto each of said condensers.

2. An air conditioning apparatus according to claim 1, wherein said at least one guide member has a length substantially equal to the width of each of said condensers and in parallel with the direction of width of each of said condensers and is disposed on the ceiling surface.

3. An air conditioning apparatus according to claim 1, wherein said at least one guide member is disposed on the ceiling surface at an inclination with respect to the direction of width of each of said condensers.

4. An air conditioning apparatus according to claim 1, wherein said at least one guide member has a groove formed therein to enable the drain water to be dripped therefrom.

* * * * *